United States Patent [19]

Johnson et al.

[11] Patent Number: 4,793,969

[45] Date of Patent: Dec. 27, 1988

[54] PROCESS FOR PRODUCING TUNGSTEN HEAVY ALLOY SHEET USING HIGH TEMPERATURE PROCESSING TECHNIQUES

[75] Inventors: Walter A. Johnson, Towanda; Preston B. Kemp, Jr., Athens; Nelson E. Kopatz, Sayre, all of Pa.

[73] Assignee: GTE Products Corporation, Stamford, Conn.

[21] Appl. No.: 143,869

[22] Filed: Jan. 14, 1988

[51] Int. Cl.[4] ..... B22F 1/00

[52] U.S. Cl. ..... 419/31; 75/0.5 BB; 75/248; 419/36; 419/40; 419/43; 419/47; 419/53; 419/54

[58] Field of Search ..... 75/248, 31.50 BB, 0.5 B; 419/36, 40, 47, 53, 54, 43

[56] References Cited

U.S. PATENT DOCUMENTS 3,890,145 6/1975 Hivert et al. ..... 419/36

4,698,096 10/1987 Schmidberger et al. ..... 75/248

*Primary Examiner*—Stephen J. Lechert, Jr.

*Attorney, Agent, or Firm*—Donald R. Castle; L. Rita Quatrini

[57] ABSTRACT

A process is disclosed for producing a sheet of tungsten heavy alloy which comprises forming metal particles of the alloy wherein each metal particle is a uniform admixture of the alloy components, entraining the particles in a carrier gas, passing the particles and the carrier gas into a high temperature zone at a temperature above the melting point of the matrix phase of the particles and maintaining the particles in the zone for a sufficient time to melt at least the matrix phase of the particles and form spherical particles, followed by rapidly and directly solidifying the high temperature treated material while the material is in flight. A slurry is formed of this high temperature treated material and a liquid medium, the liquid medium is removed from the material and a planar cake is formed of the material, the cake is dried, and sintered to a density equal to or greater than about 90% of the theoretical density of the alloy to form the sheet.

8 Claims, No Drawings

PROCESS FOR PRODUCING TUNGSTEN HEAVY ALLOY SHEET USING HIGH TEMPERATURE PROCESSING TECHNIQUES

CROSS REFERENCE TO RELATED APPLICATIONS

This invention is related to the following applications: attorney's docket D-87-2-052 entitled "Process For Producing Tungsten Heavy Alloy Sheet", Ser. No. 143,866, D-87-2-053 entitled "Process For Producing Tungsten Heavy Alloy Sheet Using A Metallic Salt Binder", Ser. No. 143,878, D-87-2-054 entitled "Process For Producing Tungsten Heavy Alloy Sheet Using Hydrometallurgically Produced Tungsten Heavy Alloy", Ser. No. 143,864, D-87-2-176 entitled "Process For Producing Tungsten Heavy Alloy Sheet By Direct Hydrometallurgical Process", Ser. No. 143,873, and D-87-2-196 entitled "Process For Producing Tungsten Heavy Alloy Sheet by A Loose Fill Hydrometallurgical Process", Ser. No. 143,865, all of which are filed concurrently herewith and all of which are assigned to the same assignee as the present application.

This invention relates to a process for producing tungsten heavy alloy sheet by sintering a preform planar cake which is substantially close in thickness to the final thickness of the rolled sheet. More particularly, the cake is formed from the component metal powders which have been produced by high temperature processing, most preferably plasma melting rapid solidification (PMRS) techniques.

BACKGROUND OF THE INVENTION

Tungsten heavy alloy sheet can be produced by rolling sintered slabs of the alloy. Because the rolling requires numerous anneals it is desirable that the starting slab be no more than about twice the final thickness. One method to produce these slabs is by isostatically pressing the powder alloy blends and sintering them to full density. With thin slabs it is difficult to get a uniform fill of the mold so the resulting slabs are not uniform in thickness. There is also a problem with breakage with the thin slabs. Using this method, it is not possible to produce slabs with a surface area to thickness ratio much over 600 or thickness less than about 0.5".

Another method of making tungsten heavy alloy sheet is to press large billets and cut the green billet into thin slabs. While this process produces slabs of uniform thickness it has the size limitations of the previous method and there is the added expense of cutting.

It would be desirable to make a sheet preform substantially close in thickness to the final thickness of the rolled sheet. This would reduce the time, energy, and labor required for hot rolling and annealing.

U.S. Pat. Nos. 3,909,241 and 3,974,245 relate to free flowing powders which are produced by feeding agglomerates through a high temperature plasma reactor to cause at least partial melting of the particles and collecting the particles in a cooling chamber containing a protective gaseous atmosphere where the particles are solidified. In this patent, the powders are used for plasma coating and the agglomerated raw materials are produced from slurries of metal powders and binders.

SUMMARY OF THE INVENTION

In accordance with one aspect of this invention, there is provided a process for producing a sheet of tungsten heavy alloy which comprises forming metal particles of the alloy wherein each metal particle is a uniform admixture of the alloy components, entraining the particles in a carrier gas, passing the particles and the carrier gas into a high temperature zone at a temperature above the melting point of the matrix phase of the particles and maintaining the particles in the zone for a sufficient time to melt at least the matrix phase of the particles and form spherical particles, followed by rapidly and directly solidifying the high temperature treated material while the material is in flight. A slurry is formed of this high temperature treated material and a liquid medium, the liquid medium is removed from the material and a planar cake is formed of the material, the cake is dried, and sintered to a density equal to or greater than about 90% of the theoretical density of the alloy to form the sheet.

DETAILED DESCRIPTION OF THE INVENTION

For a better understanding of the present invention, together with other and further objects, advantages and capabilities thereof, reference is made to the following disclosure and appended claims in connection with the above description of some of the aspects of the invention.

The process of the present invention relates to a process for producing tungsten heavy alloy sheet with component metal powders of the alloy as the starting material. Particles are formed of the component alloy metal powders so that each particle is itself a uniform admixture of the alloy components in the proportions in which they are in the alloy. These particles are then high temperature processed such as by PMRS techniques to produce spherical alloy particles which are then slurried to produce a planar cake which is very close in dimension to the sheet to be formed. The cake is then sintered to form the sheet. The sheet can then be rolled and annealed as necessary to produce the final dimensions. As a result of formation of this type of cake, there is a reduction in time, energy and labor required for hot rolling and annealing.

Some tungsten heavy alloys which are especially suited to this invention, although the invention is not limited to these, are tungsten-iron-nickel alloys especially those in which the Ni:Fe weight ratio is from about 1:1 to about 9:1 and most preferably about 8:2. As an example of these preferred alloys are those having the following composition in percent by weight: about 8% Ni, about 2% Fe, and the balance of W, about 4% Ni, about 1% Fe, and the balance W, and about 5.6% Ni, about 1.4% Fe, and the balance W. The alloys can be with or without additions of Co and/or Cu.

The mixture of metal powder particles in which each particle is a uniform admixture of the alloy components can be formed by any method. However some of the preferred methods of obtaining this type of mixture are described below.

In accordance with one embodiment, the mixture can be formed by agglomerating the metal powder particle components with an organic binder. This can be done by methods known in the art such as by spray drying etc. Typical binders include waxes, polymers, and others which are known in the art. Each agglomerate thus formed is considered to be a particle which is the admixture of the alloy components. The organic binder or binders are then removed from the agglomerates by standard dewaxing techniques. The resulting dewaxed agglomerates are sintered by known methods to impart strength to the agglomerates. The sintering conditions will depend on the nature of the components and one skilled in the art would be able to carry out this step.

In accordance with another embodiment, the mixture can be formed by hydrometallurgical techniques. In this technique, a solution is formed of chemical compounds containing the metal values of the alloy in the correct proportion as in the alloy. This can be done by any technique, such as by dissolving the compounds as is in the solution.

In accordance with one method of making the solution, the elemental metal powder components of the alloy are first dissolved in an acid solution. Calculation of the required relative amounts of the elemental powders is determined by the compositions of the alloy to be produced. Dissolution of the metal values in acid solution and calculation of the amounts of metal required for the alloy composition can be done by anyone skilled in the art. The acid can be a mineral acid such as hydrochloric, sulfuric, or nitric acids or an organic acid such as acetic, formic, and the like. Hydrochloric acid is especially preferred because of cost and availability. As a result of the acid dissolution of the metal powders, compounds of the respective metals are formed as precipitate. Those skilled in the art would know how to dissolve metal values in acid solution in the correct proportions.

In accordance with another preferred method of making the solution, nickel powder and iron powder are dissolved in hydrochloric acid. A concentrated solution of ammonium metatungstate is added to the hydrochloric acid solution of nickel and iron. The amounts of iron, nickel, and tungsten have been calculated to be the proper amounts to result in the desired alloy. The pH of the resulting solution is raised to the basic side, usually to a pH of about 6.5 to about 7.5 with ammonia or ammonium hydroxide to precipitate the tungsten as ammonium paratungstate (APT) and the iron and nickel as their hydroxides.

The resulting compounds are then removed from solution. This is done by any standard technique such as by filtration of a precipitate that has formed. In this case, the precipitate of the compounds is dried. Alternately, if the compounds are highly soluble as is the case when ammonium metatungstate is one of the compounds, the solution can be spray dried to crystallize the compounds.

The compounds, if they are insoluble in water can then be water washed if desired to remove any contaminants.

The compounds are then reduced to their respective metals to obtain the admixture. This is done by standard reduction techniques. For example, the reduction to metals can be done in one step or more than one step. As an example of the latter, the compounds which can be predried if desired, are first heated to decompose them into their oxides. Temperature depends on the nature of the metals. Time depends on the nature of the metals, temperature, amount of material being processed, the nature of the equuipment, etc. In the preferred case of ammonium paratungstate (APT), iron hydroxide and nickel hydroxide, the reduction furnace is slowly ramped from room temperature to almost about 275° C. to remove ammonia and water vapor from the APT to form $WO_3$. The temperature is next ramped to 750° C. to about 800° C. to reduce the hydroxides and oxides to their respective metals. As a result of reducing compounds which have been hydrometallurgically produced from solution, each of the resulting metal particles is an admixture in itself of all the component metals which form the alloy. Sintering is not necessary because by hydrometallurgical processing the alloy components are bound together.

The resulting sintered agglomerates or reduced powder particles, depending on which method was used to produce the admixture are now high temperature processed as follows to spheroidize the major portion of them. The particles are entrained in a carrier gas such as argon and passed through a high temperature zone at a temperature above the melting point of the particles and maintained in the high temperature zone for a sufficient time to melt at least the matrix phase of the particles and form essentially spherical particles. The preferred high temperature zone is a plasma.

Details of the principles and operations of plasma reactors are well known. The plasma has a high temperature zone, but in cross section the temperature can vary from about 5500° C. to about 17,000° C. The outer edges are at low temperatures and the inner part is at a higher temperature. The retention time depends upon where the particles entrained in the carrier gas are injected into the nozzle of the plasma gun. Thus, if the particles are injected into the outer edge, the retention time must be longer, and if they are injected into the inner portion, the retention time is shorter. The residence time in the plasma flame can be controlled by choosing the point at which the particles are injected into the plasma. Residence time in the plasma is a function of the physical properties of the plasma gas and the powder particles themselves for a given set of plasma operating conditions and powder particles. Larger particles are more easily injected into the plasma while smaller particles tend to remain at the outer edge of the plasma jet or are deflected away from the plasma jet.

As the material passes through the plasma and cools, it is rapidly and directly solidified. Generally the major weight portion of the material is converted to spherical particles. Generally greater than about 75% and most typically about 85% by weight of the material is converted to spherical particles by the high temperature treatment. Nearly 100% conversion to spherical particles can be attained.

A slurry of the resulting high temperature treated material and a liquid medium is formed. The liquid medium can be water or organic solvents, which can be oxygen containing or non-oxygen containing organic solvents. Typical oxygen containing organic solvents are alcohols; one in particular being a reagent alcohol which is about 90% by weight ethyl alcohol, about 5% by weight methyl alcohol, and about 5% by weight isopropyl alcohol. Other solvents that can be used are alkane hydrocarbon liquids and chlorinated hydrocabon liquids. The slurry can have other components such as organic or inorganic binders, etc. The actual formation of the slurry can be done by standard methods.

The liquid medium is then removed from the material. This is done in such a way so that the material forms into a planar cake which is substantially close in thickness to the thickness of the final rolled sheet. The thickness of the sheet is typically from about 0.1" to about 0.5" after sintering and before rolling. By a planar cake is meant that the cake is uniform in thickness and density across the length and width of the cake The cake is uniform in composition throughout by virtue of the fact that each particles is an admixture of the alloy components. The preferred methods of forming the planar cake are by using a porous filter medium and applying vacuum, gas pressure, or mechanical pressure. Vibration can also be used if this is desirable. The liquid removal can be accomplished by batch or continuous processing.

The resulting cake is then dried by conventional powder metal drying methods to remove essentially all of the liquid therefrom, the methods being selected to reduce or eliminate cracking during drying. Any organic binders which may be present are removed by standard dewaxing techniques.

At this point, if the liquid medium has been water or an oxygen containing organic solvent, oxygen must be removed from the cake. This is done by heating the cake in hydrogen at a temperature sufficient to reduce any metal oxides which are present to their respective metals but below the normal sintering temperatures of any metal contained therein. By "normal sintering temperature" is meant the temperature at which the cake is sintered to the final desired density. A minor amount of sintering can take place at this point and this is advantageous because it strengthens the cake and it is easier to handle if handling is necessary. This temperature is most typically from about 800° C. to about 1000° C. The time of heating depends on factors as the temperature, size of charge, thickness of the cake, nature of the equipment, etc.

The resulting dried and heated cake is then sintered by well known methods to a density at or near the theoretical density. This is considered to be equal to or greater than about 90% of the theoretical density of the alloy. Depending on the application and on the composition, the cake can be solid state or liquid phase sintered to form the sheet. For example, if the sheet is to be rolled, it is necessary to get the density to at least about 90% to about 93% of the theoretical. With a weight composition consisting essentially of about 7% Ni, about 3% Fe, and about 90% W, solid state sintering would be sufficient. Sintering temperatures and times depend on the nature of the alloy and on the density desired for the specific application. In the example above, the solid state sintering temperature is from about 1400° C. to about 1430° C. Liquid phase sintering is preferable for better rolling, higher density and healing of cracks which can form during drying. Densities of about 99.4% of theoretical have been achieved. Usually liquid phase sintering results in a more uniform composition of the alloy components throughout the sheet.

The resulting sheet can now be processed by known methods of hot rolling and annealing to form the final size sheet. However, when the process of the present invention is followed to produce the sintered sheet preform less rolling and annealing are required than with sheets formed by prior art methods. This is because the cake has been formed to a size very close to the desired size of the final sheet. The liquid phase sintering temperature is above the solidus temperature of the matrix phase of the alloy but below the melting point of tungsten.

While there has been shown and described what are at present considered the preferred embodiments of the invention, it will be obvious to those skilled in the art that various changes and modifications may be made therein without departing from the scope of the invention as defined by the appended claims.

What is claimed is:

1. A process for producing a sheet of tungsten heavy alloy, said process comprising:

(a) forming metal particles of said alloy wherein each metal particle is a uniform admixture of said alloy components;

(b) entraining said particles in a carrier gas to form entrained particles;

(c) passing said entrained particles and said carrier gas into a high temperature zone at a temperature above the melting point of the matrix phase of said particles and maintaining said particles in said zone for a sufficient time to melt at least said matrix phase of said particles and form spherical particles;

(d) rapidly and directly resolidifying the resulting high temperature treated material, while said material is in flight;

(e) forming a slurry of said high temperature treated material and a liquid medium;

(f) removing said liquid medium from said high temperature treated material forming a planar cake of said high temperature treated material;

(g) drying said cake; and (h) sintering said cake to a density equal to or greater than about 90% of the theoretical density of said alloy to form said sheet.

2. A process of claim 1 wherein said metal particles are formed by a process which comprises the steps of:

(a) agglomerating said alloy metal powder components with an organic binder to form agglomerates each of which is an admixture of the components of said alloy in the proper proportion as in said alloy;

(b) removing said organic binders from the resulting agglomerated powder components to form dewaxed agglomerates; and (c) sintering said dewaxed agglomerates to form sintered agglomerates.

3. A process of claim 1 wherein said admixture is formed by a process which comprises the steps of:

(a) forming a solution of chemical compounds containing metal values of said alloy in the correct proportions as in said alloy;

(b) crystallizing said compounds from said solution and drying said compounds; and (c) reducing said compounds to their respective metals wherein each particle is an admixture of the alloy components.

4. A process of claim 1 wherein said high temperature is a plasma.

5. A process of claim 1 wherein said liquid medium is selected from the group consisting of water, oxygen containing organic solvents, and non-oxygen containing organic solvents.

6. A process of claim 5 wherein said liquid medium is selected from the group consisting of water and oxygen-containing organic solvents.

7. A process of claim 6 wherein the dried cake before the sintering step is heated in hydrogen at a temperature sufficient to reduce any metal oxides which are present to their respective metals but below the sintering temperature of any metal contained therein.

8. A process of claim 7 wherein said temperature is from about 800° C. to about 1000° C.

* * * * *